US008367915B1

(12) United States Patent
Chang

(10) Patent No.: US 8,367,915 B1
(45) Date of Patent: Feb. 5, 2013

(54) STRING COMPACT ADJUSTMENT APPARATUS

(76) Inventor: Tsung-Min Chang, Taichung (TW)

( * ) Notice: Subject to any disclaimer, the term of this patent is extended or adjusted under 35 U.S.C. 154(b) by 0 days.

(21) Appl. No.: 13/410,483

(22) Filed: Mar. 2, 2012

(51) Int. Cl.
*G10D 3/14* (2006.01)

(52) U.S. Cl. ..... 84/304

(58) Field of Classification Search ..... 84/173, 84/290, 304
See application file for complete search history.

(56) References Cited

U.S. PATENT DOCUMENTS 4,748,889 A * 6/1988 Schaller ..... 84/304

* cited by examiner

*Primary Examiner* — Kimberly Lockett
(74) *Attorney, Agent, or Firm* — Muncy, Geissler, Olds & Lowe, PLLC

(57) ABSTRACT

A string compact adjustment apparatus installed on a head of a stringed instrument includes a tuning peg, a pintle, a string holder, a holding ring, a clamp ring and a compact bushing. The pintle runs through the head. The holding ring and clamp ring run through the pintle and fixedly couple on the head. The string holder is fastened to one end of the pintle close to the holding ring, and the tuning peg is fastened to another end thereof. The compact bushing has a contact surface and the clamp ring has a mating latch surface. The compact bushing is pushed by the tuning peg to allow the contact surface to tightly press the latch surface so that the compact bushing is fixedly coupled on the tuning peg and the tuning peg is fixed without turning reversely, thus string tone can be maintained for a long duration.

7 Claims, 6 Drawing Sheets

STRING COMPACT ADJUSTMENT APPARATUS

FIELD OF THE INVENTION

The present invention relates to a stringed instrument structure and particularly to a string adjustment apparatus of stringed instruments.

BACKGROUND OF THE INVENTION

Conventional stringed instruments include cellos, violas, violins, guitars, ukuleles and the like. They generate sound through resonance of strings and an acoustic box. The tension of the strings directly affects the intonation.

Please refer to FIGS. 1 and 2 for a conventional adjustment apparatus for tuning the tone of the stringed instruments. It is installed on a head 1 and includes a tuning peg 2, a pintle 3, a string holder 4, a holding ring 5, a clamp ring 6 and a plurality of anti-slip washers 7. The pintle 3 runs through the head 1. The holding ring 5 and clamp ring 6 run through the pintle 3 from two sides of the head 1 and fixedly couple on the head 1. The string holder 4 is fixedly mounted onto one end of the pintle 3 close to the holding ring 5, and the tuning peg 2 is fixedly coupled on another end thereof. The anti-slip washers 7 are run through by the pintle 3 and interposed between the tuning peg 2 and clamp ring 6. The tuning peg 2 presses the anti-slip washers 7 to compress the clamp ring 6 to fix together. The string holder 4 and holding ring 5 may also be interposed by the anti-slip washers 7 to increase anti-slip forces.

The string holder 4 allows a string 8 to fasten thereon. By turning the tuning peg 2, the pintle 3 is driven to drive the string holder 4 to turn, thereby the length of the string 8 can be changed to adjust the tension thereof to further alter the tone to meet performance requirements.

The string holder 4 is threaded through by a string 8. Turning the tuning peg 2, the pintle 3 is driven to turn the string holder 4, thereby the length of the string 8 can be changed to adjust the tension of the string 8, and thus the tone of the string 8 also can be changed to meet performance requirement.

In the conventional string compact adjustment apparatus, the tuning peg 2 and clamp ring 6 are held together merely via frictional force generated by contact between the anti-slip washers 7. When the string 8 is played to generate vibration, the conventional holding structure set forth above cannot prevent the tuning peg 2 from turning reversely and slowly. As a result, the tuning peg 2 gradually loosens and the timber changes during the performance. It cannot meet performance requirement.

SUMMARY OF THE INVENTION

Therefore, the primary object of the present invention is to provide an adjustment apparatus to avoid strings from turning reversely.

To achieve the foregoing object, the present invention provides a string compact adjustment apparatus. It is installed on a head of a stringed instrument and includes a pintle, a holding ring, a clamp ring, a string holder, a tuning peg and a compact bushing. The pintle runs through the head. The holding ring and clamp ring run through the pintle via two sides of the head and fixedly couple on the head. The string holder is fixedly mounted onto one end of the pintle close to the holding ring, and the tuning peg is fixedly fastened to another end of the pintle.

The compact bushing has a contact surface, and the clamp ring has a corresponding latch surface. When the compact bushing is fixedly coupled on the tuning peg, it is pushed by the tuning peg to allow the contact surface to tightly press the latch surface.

Thus, when the string holder is threaded through by a string, and the tuning peg is turned to a selected position for tuning, the contact surface and latch surface contact with each other to form a compact latching to securely anchor the tuning peg. As the aforesaid latching is accomplished via the contact surface formed at a gradient, when the string is vibrated during performance, the tuning peg remains stationary without turning reversely, thus the string tone can be maintained for a long duration to meet use requirement.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
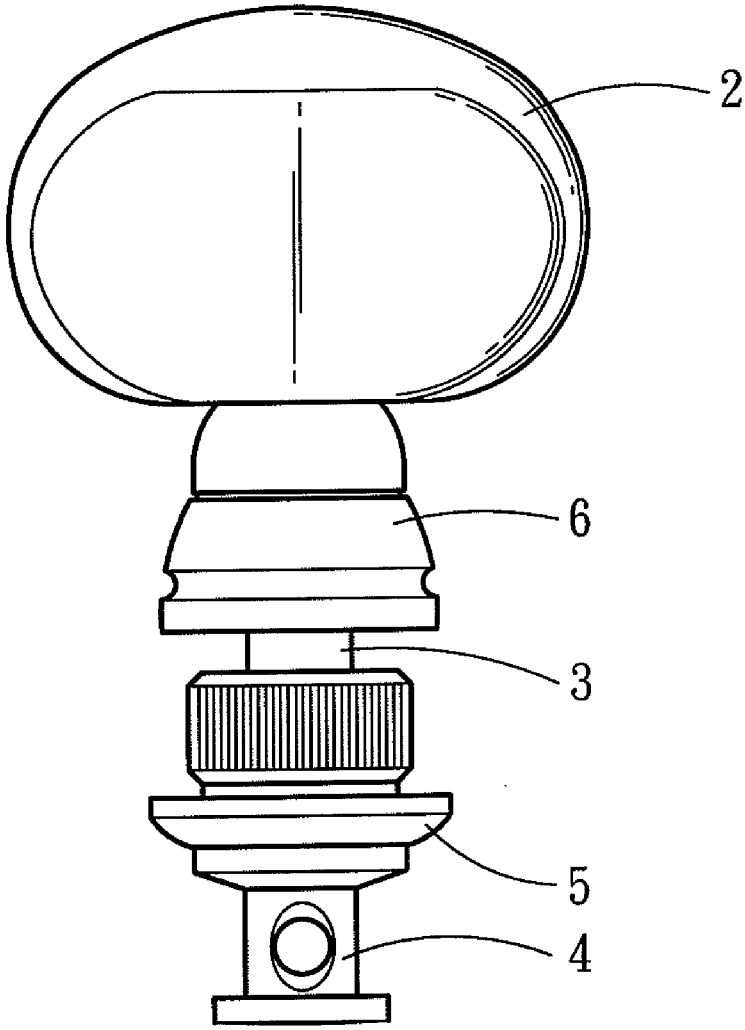
Fig . 1 PRIOR ART
FIG. 1 is a schematic view of a conventional structure.
Figure 2:
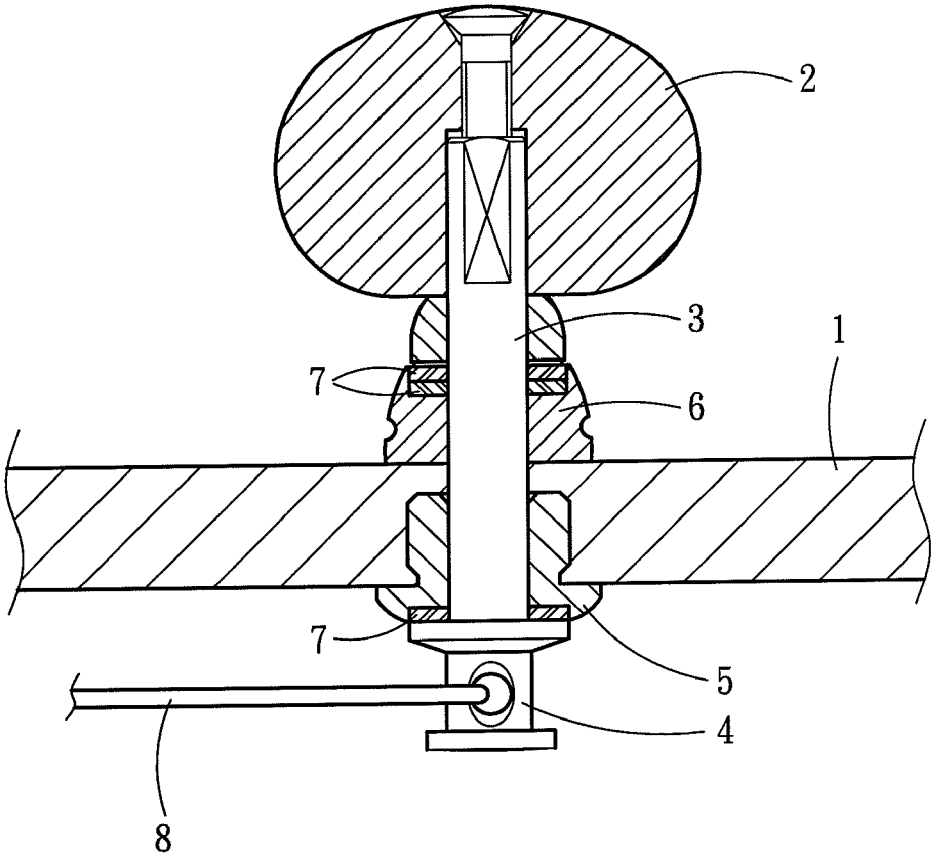
Fig . 2 PRIOR ART
FIG. 2 is a sectional view of a conventional structure.
Figure 3:
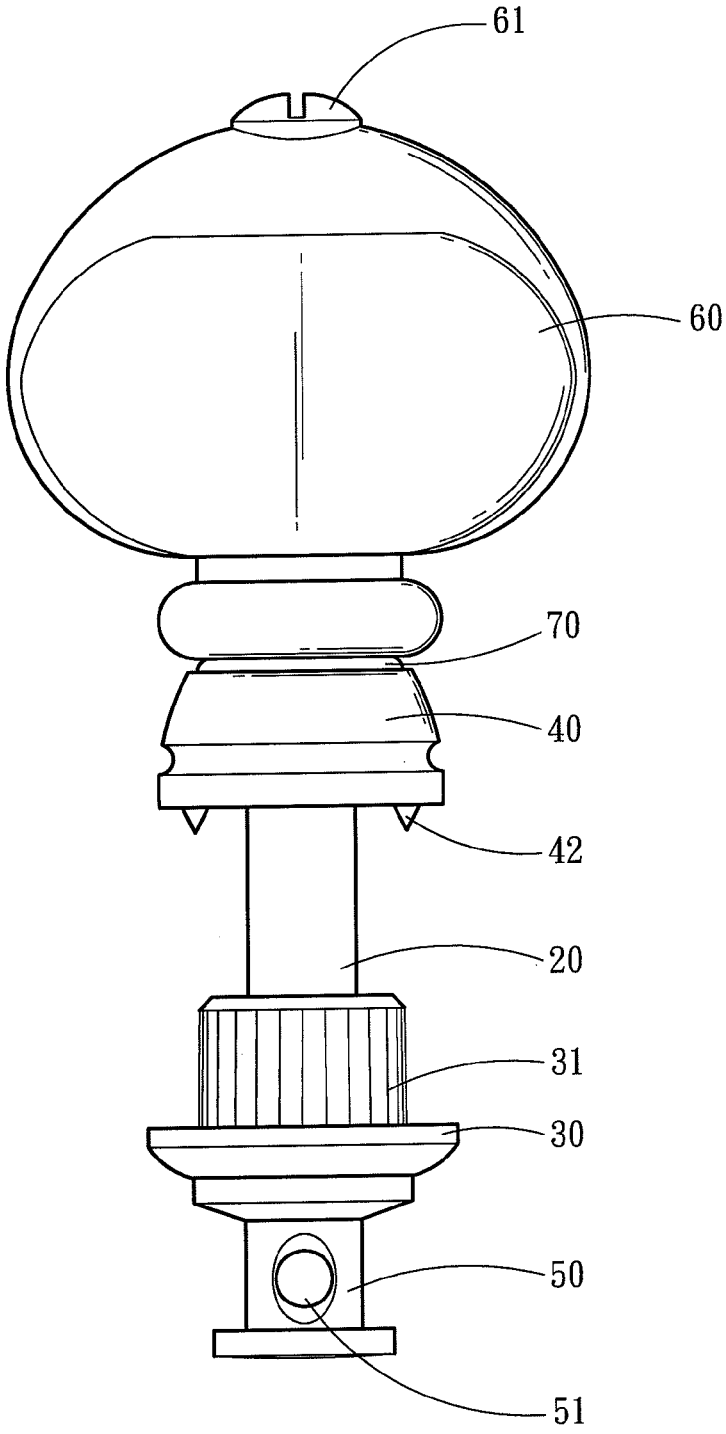
FIG. 3 is a schematic view of the structure of the invention.
Figure 4:
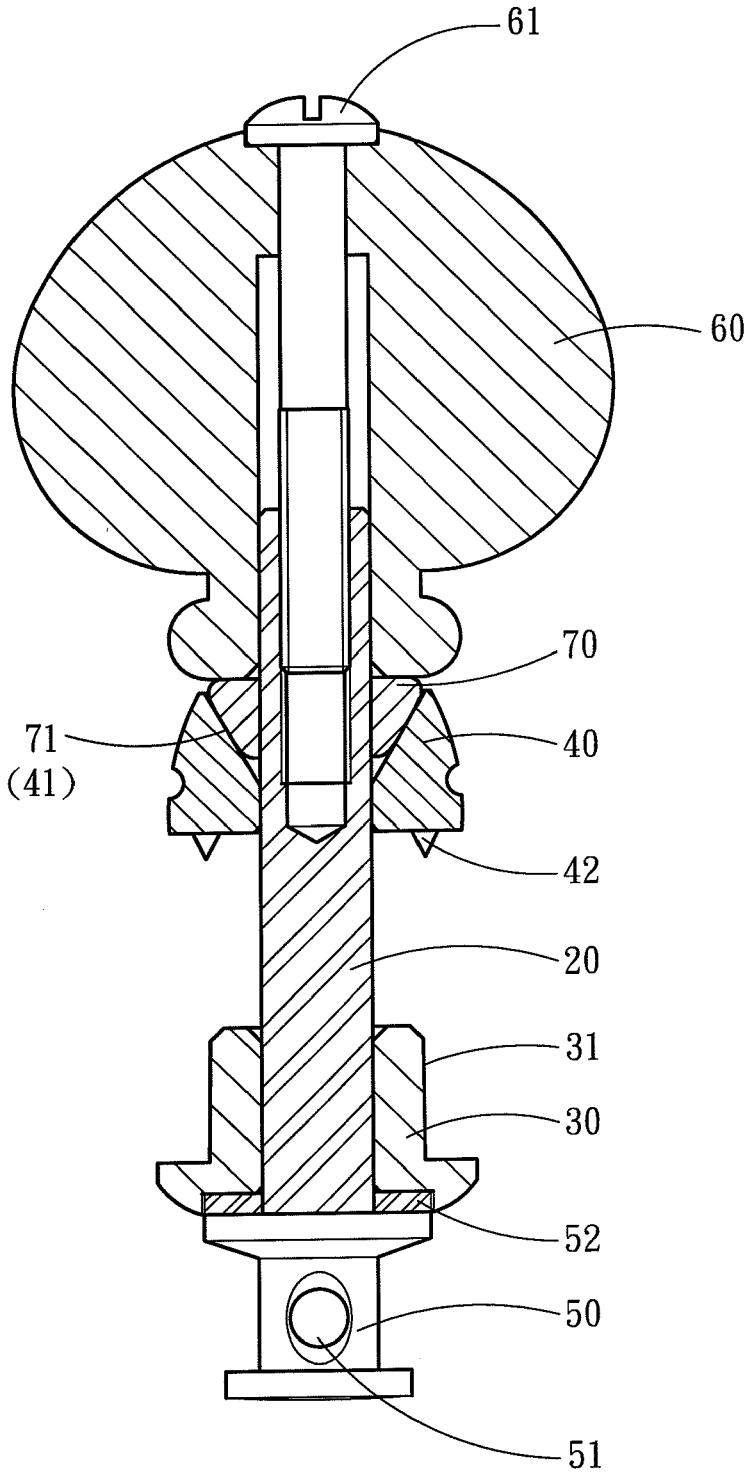
FIG. 4 is a sectional view of the structure of the invention.
Figure 5:
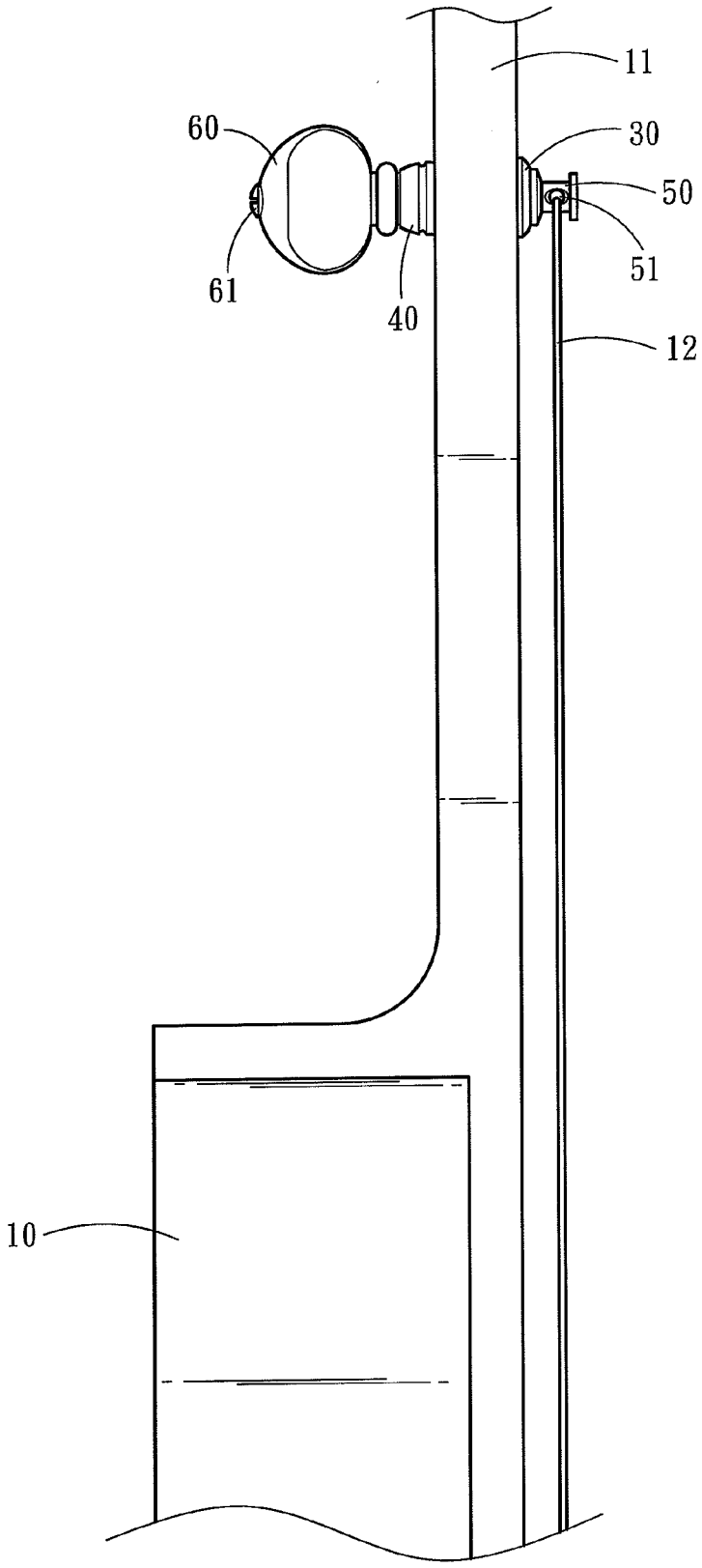
FIG. 5 is a schematic view of the invention in a use condition.
Figure 6:
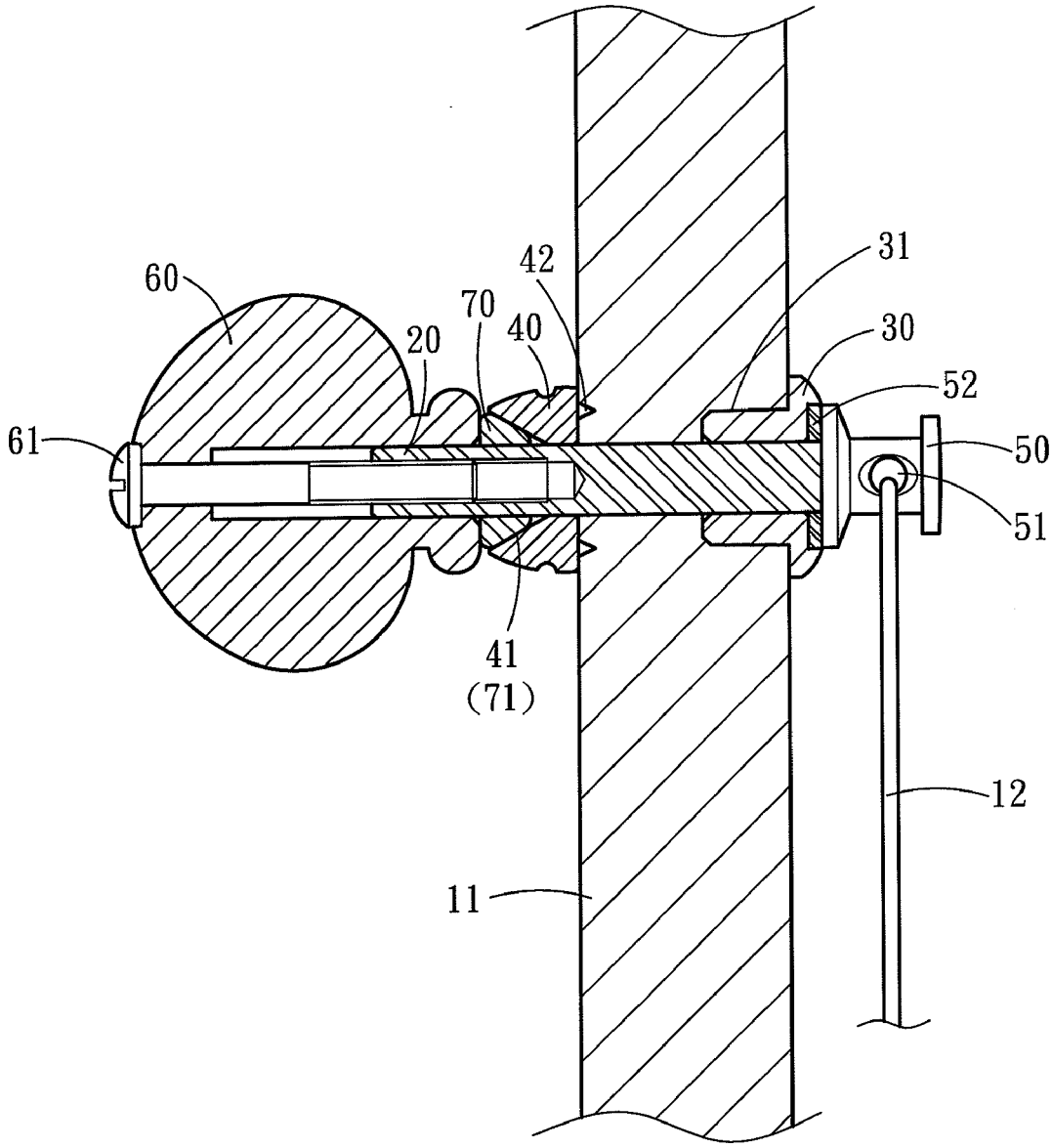
FIG. 6 is a sectional view of the invention in a use condition.

Please refer to FIGS. 3 through 6, the present invention aims to provide a string compact adjustment apparatus installed on a head 11 of a stringed instrument 10. The apparatus comprises a pintle 20, a holding ring 30, a clamp ring 40, a string holder 50, a tuning peg 60 and a compact bushing 70. The pintle 20 runs through the head 11. The holding ring 30 and clamp ring 40 run through the pintle 20 via two sides of the head 11 and fixedly couple on the head 11. The clamp ring 40 has at least one nail 42 to pierce into the head 11 for anchoring. The holding ring 30 has an annular teeth surface 31 piercing into the head 11 to latch the head 11 for anchoring.

The string holder 50 is fastened to one end of the pintle 20 close to the holding ring 30 and has a holding aperture 51 threaded through by a string 12 of the stringed instrument 10. The tuning peg 60 is fastened to another end of the pintle 20 and run through by a screw 61 fastened to the pintle 20 for anchoring.

The compact bushing 70 has a contact surface 71, and the clamp ring 40 has a corresponding latch surface 41. The contact surface 71 and latch surface 41 are formed with mating profiles to provide optimal friction force. When the compact bushing 70 is fixedly coupled on the tuning peg 60, it is pushed by the tuning peg 60 to allow the contact surface 71 to tightly press the latch surface 41. To further achieve desired anchoring effect, the contact surface 71 and latch surface 41 can be formed in mating conical surfaces.

In addition, the string holder 50 and holding ring 30 can be interposed by an anti-slip washer 52 to enhance the friction force between them.

By means of the construction set forth above, a compact latch structure is formed. The contact surface 71 and latch surface 41 are tightly in contact with each other at a gradient to form compact latching, thus is provided improved vibration resistant capability. After the string 12 is threaded through the string holder 50 and the tuning peg 60 is turned to a selected position for tuning, a desired tone can be generated to meet performance requirement. The structure of the invention can resist the vibration of the string 12 generated during the performance, namely the tuning peg 60 does not turn in reverse, hence the tone of the string 12 can be maintained for a long duration to meet use requirement.

The stringed instrument 10 mentioned in the invention can be a cello, viola, violin, guitar, ukulele or the like. While a ukulele is shown in the drawings previously discussed, it is not the limitation of the invention.

What is claimed is:

1. A string compact adjustment apparatus installed on a head of a stringed instrument, comprising:

a pintle running through the head;

a holding ring and a clamp ring running through the pintle from two sides of the head and fixedly coupling on the head, the clamp ring including a latch surface;

a string holder fastened to one end of the pintle close to the holding ring;

a tuning peg fastened to another end of the pintle; and a compact bushing which includes a contact surface corresponding to the latch surface and is pushed by the tuning peg to allow the contact surface to tightly press the latch surface so that the compact bushing is fixedly coupled on the tuning peg.

2. The string compact adjustment apparatus of claim 1, wherein the tuning peg is run through by a screw fastened to the pintle.

3. The string compact adjustment apparatus of claim 1, wherein the string holder includes a holding aperture threaded through by a string.

4. The string compact adjustment apparatus of claim 1 further including an anti-slip washer interposed between the string holder and the holding ring.

5. The string compact adjustment apparatus of claim 1, wherein the clamp ring includes at least one nail piercing into the head.

6. The string compact adjustment apparatus of claim 1, wherein the holding ring includes an annular teeth surface piercing into the head.

7. The string compact adjustment apparatus of claim 1, wherein the contact surface and the latch surface are formed respectively in a conical shape mating each other.

* * * * *